US005558716A

United States Patent [19]

Mitani et al.

[11] Patent Number: 5,558,716

[45] Date of Patent: Sep. 24, 1996

[54] COATING MACHINE WITH AN ADJUSTABLE NOZZLE AND A PRESSURE SENSOR

[75] Inventors: Shigetoshi Mitani; Takeshi Matsumoto, both of Nara, Japan

[73] Assignee: Hirano Tecseed Co., Ltd., Nara, Japan

[21] Appl. No.: 41,832

[22] Filed: Apr. 1, 1993

[51] Int. Cl.[6] ..... B05C 11/00

[52] U.S. Cl. ..... 118/674; 118/410; 118/683

[58] Field of Search ..... 118/683, 679, 118/419, 686, 712, 674, 410; 427/8–10

[56] References Cited

U.S. PATENT DOCUMENTS

| | | | |
|---|---|---|---|
| 4,704,296 | 11/1987 | Leanna et al. | 118/665 |
| 4,776,997 | 10/1988 | Chino | 118/675 |
| 4,899,691 | 2/1990 | Fritzgerald, Jr. et al. | 118/665 |
| 5,147,462 | 9/1992 | Wollam | 118/712 |

FOREIGN PATENT DOCUMENTS

| | | | |
|---|---|---|---|
| 617632 | 4/1961 | Canada | 118/683 |
| 2-152574 | 6/1990 | Japan . | |
| 4-161267 | 6/1992 | Japan . | |
| 2114471 | 8/1983 | United Kingdom | 118/683 |

*Primary Examiner*—Brenda A. Lamb
*Attorney, Agent, or Firm*—Michael N. Meller

[57] ABSTRACT

A coating machine comprising a backing roll and a lip-type nozzle with a doctor edge. The nozzle comprises a first chamber connected to the inlet, a passage, and an outlet for discharging the liquid coating material under pressure toward a web on the backing roll. The outlet comprises a recess in the upper wall of the nozzle body extending toward the doctor edge to form a second chamber at the outlet. A pressure sensor is arranged in the second chamber. A thickness sensor is arranged to detect the thickness of the coated layer. The nozzle is adjustably supported to the machine frame by the left-end, central, and right-end support means, which are controlled in accordance with outputs of the pressure sensor and the thickness sensor so as to obtain a uniform coating layer. Also, the speed of the pump for delivering a coating material is suitably controlled.

6 Claims, 11 Drawing Sheets

COATING MACHINE WITH AN ADJUSTABLE NOZZLE AND A PRESSURE SENSOR

BACKGROUND OF THE INVENTION

1. Field of the Invention

The present invention relates to a coating machine having a nozzle for discharging a liquid coating material under pressure toward a web on a backing roll.

2. Description of the Related Art

This type of coating machine is known as a die coater, which comprises a nozzle extending parallel to a backing roll for discharging a liquid coating material under pressure toward a web on the backing roll, and a doctor edge arranged on the nozzle adjacent the outlet at a narrow gap between the backing roll and the doctor edge for obtaining a layer of a coated material with a uniform thickness. The liquid coating material under pressure is supplied to the nozzle by a pump. The nozzle comprises a nozzle body having a chamber connected to the pump and a generally planar narrow passage with a width generally corresponding to the width of the backing roll; the upper end of the passage being an outlet for discharging the liquid coating material. The doctor edge is located at the upper surface of the nozzle body on the rear side of the outlet.

The liquid coating material is injected from the outlet and a gathering of the liquid coating material is formed between the nozzle and the backing roll. The gathering liquid covers the outlet and a portion of the backing roll facing the outlet so that the liquid coating material is continuously carried by the web on the backing roll to be coated thereon. However, the amount gathering liquid is relatively small in the conventional die coater since the outlet is at the upper end of the narrow passage. Thus, there is a tendency for air to be entrained in the liquid coating material and the layer of the liquid coating material is not uniformly formed on the web.

Japanese Unexamined Patent Publication (Kokai) No. 2-152574 filed by the assignee of the present application on Dec. 2, 1988 discloses a die coater called a lip coater including a nozzle comprising a nozzle body having a first chamber connected to an inlet, a passage with a lower end connected to the first chamber and an upper end, and an outlet connected to the upper end of the passage, the outlet comprising a recess in the upper wall extending toward the rear of the frame so as to form a second chamber between the upper wall of the nozzle body and the backing roll. The outlet of the nozzle is large in size compared with the upper end of the passage and thus a large gathering of the liquid coating material is formed. Accordingly, the above described problem of the conventional die coater can be overcome by the lip coater. In addition, a sensor is arranged in the second chamber for detecting a pressure of the gathering of the liquid coating material and a clearance between the doctor edge and the backing roll can be adjusted in response to an output of the sensor so as to stabilize the gathering of the liquid coating material.

However, there is a desire to further improve the die coater so that the layer of the liquid coating material is uniformly formed on the web even if there is a variation in the conveying speed of the web and if there is a variation in the web itself, such as a partially sagging portion.

SUMMARY OF THE INVENTION

The object of the present invention is to provide an improved coating machine by which the layer of the liquid coating material is uniformly formed on the web irrespective of a variation in the conveying speed of the web and a variation in the web.

In one aspect of the present invention, there is provided a coating machine comprising a frame, a backing roll rotatably mounted to the frame for conveying a web to be coated at a conveying speed, a nozzle mounted to the frame below the backing roll and extending parallel to the backing roll; the nozzle having an inlet for receiving a liquid coating material and an outlet for discharging the liquid coating material under pressure toward a web on the backing roll, a doctor edge arranged on the nozzle adjacent the outlet at a narrow gap between the backing roll and the doctor edge, a pump outputting a predetermined quantity of liquid coating material per revolution for supplying a liquid coating material to the inlet of the nozzle, first detecting means for detecting the conveying speed of the web, second detecting means for detecting the thickness of the coated material on the web, and a control means for controlling the pump in response to output signals from the first and second detecting means.

In another aspect of the present invention, there is provided a coating machine comprising a frame, a backing roll rotatably mounted to the frame for conveying a web to be coated at a conveying speed; the frame having a front side from which the coated web can be seen, a nozzle mounted to the frame below the backing roll and extending parallel to the backing roll; the nozzle comprising a nozzle body having an upper wall, an inlet for receiving a liquid coating material, a first chamber connected to the inlet, a passage with a width generally corresponding to a width of the backing roll, a first end connected to the first chamber and a second end, and an outlet connected to the second end of the passage for discharging the liquid coating material under pressure toward a web on the backing roll; the outlet comprising a recess in the upper wall having a size greater than a cross-sectional area of the second end of the passage and extending at least toward the front side to form a second chamber between the upper wall of the nozzle body and the backing roll, a doctor edge arranged on the nozzle adjacent the outlet at a narrow gap between the backing roll and the doctor edge, a support means including an actuator for adjustably supporting the nozzle body to the frame for adjusting a clearance between the doctor edge and the backing roll, a pump outputting a predetermined quantity of liquid coating material per revolution for supplying a liquid coating material to the inlet of the nozzle, a first detecting means for detecting the conveying speed of the web, a second detecting means for detecting the thickness of a layer of the coated material on the web, a third detecting means for detecting the pressure in the second chamber of the nozzle, a first control means for controlling the speed of the pump in response to output signals of the first and second detecting means, a second control means for controlling the actuator of the support means in response to an output signal of the third detecting means.

Preferably, the second control means controls the actuator of the support means so that the clearance between the doctor edge and the backing roll is widened when the detected pressure is higher than a predetermined maximum and the clearance is narrowed when the detected pressure is lower than a predetermined minimum.

Preferably, the second control means controls the actuator of the support means in response to an output signal of the second detecting means as well as an output signal of the third detecting means.

Preferably, the support means comprises a central support element including an actuator located at a central region of the frame, a left support element including an actuator located at a left end region of the frame, and a right support element including an actuator located at a right end region of the frame for adjustably supporting the nozzle body to the frame for adjusting the clearance between the doctor edge and the backing roll, respectively.

In this case, the second detecting mans detects the thickness of the coated material on the web at least three transversely selected points. Preferably, the second control means controls the left and right support means so that the clearance between the doctor edge and the backing roll is widened when the detected pressure is higher than a predetermined maximum and the clearance is narrowed when the detected pressure is lower than a predetermined minimum. In addition, the second control means controls each of the actuators of the left, central and right support means in response to the detected pressure at the correspondingly located point.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
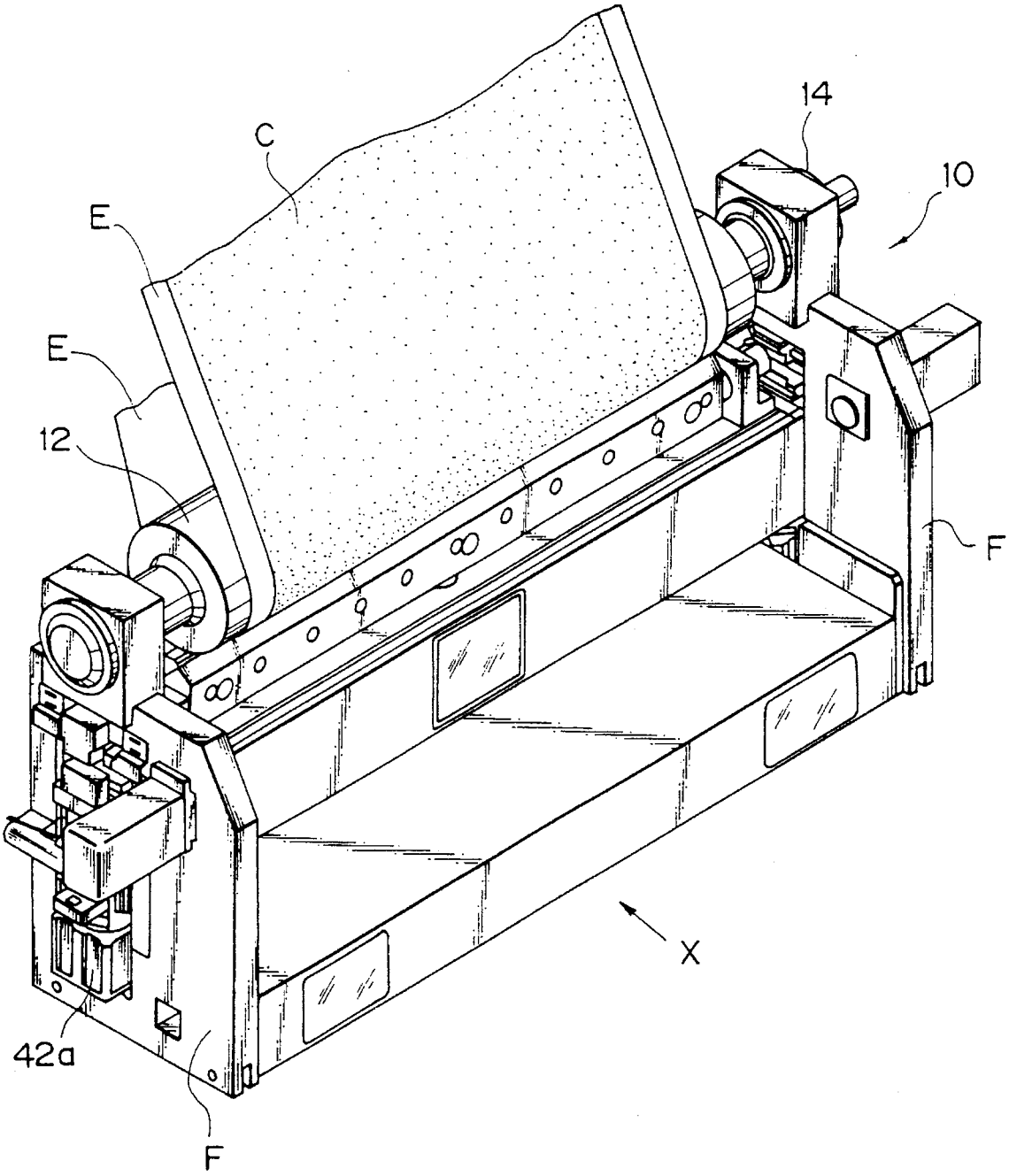
FIG. 1 is a perspective view of a coating machine according to the embodiment of the present invention.

FIGS. 1 to 5 show a coating machine 10 according to the present invention, comprising a frame F and a backing roll 12 rotatably mounted to the frame F at the top thereof for conveying a web E to be coated at a conveying speed to a heating station. An electric motor 14 is mounted to the frame F at one side of the backing roll 12. The frame F has a front side, as shown by the arrow X, and a rear side, as shown by the arrow Y. The layer C of a liquid material coated on the web E can be seen from the front of the frame F, as shown in FIG. 1.

A nozzle 16 is mounted to the frame F below the backing roll 12 and extending parallel to the backing roll 12 for discharging the liquid coating material under pressure toward the web E on the backing roll 12.

Figure 2:
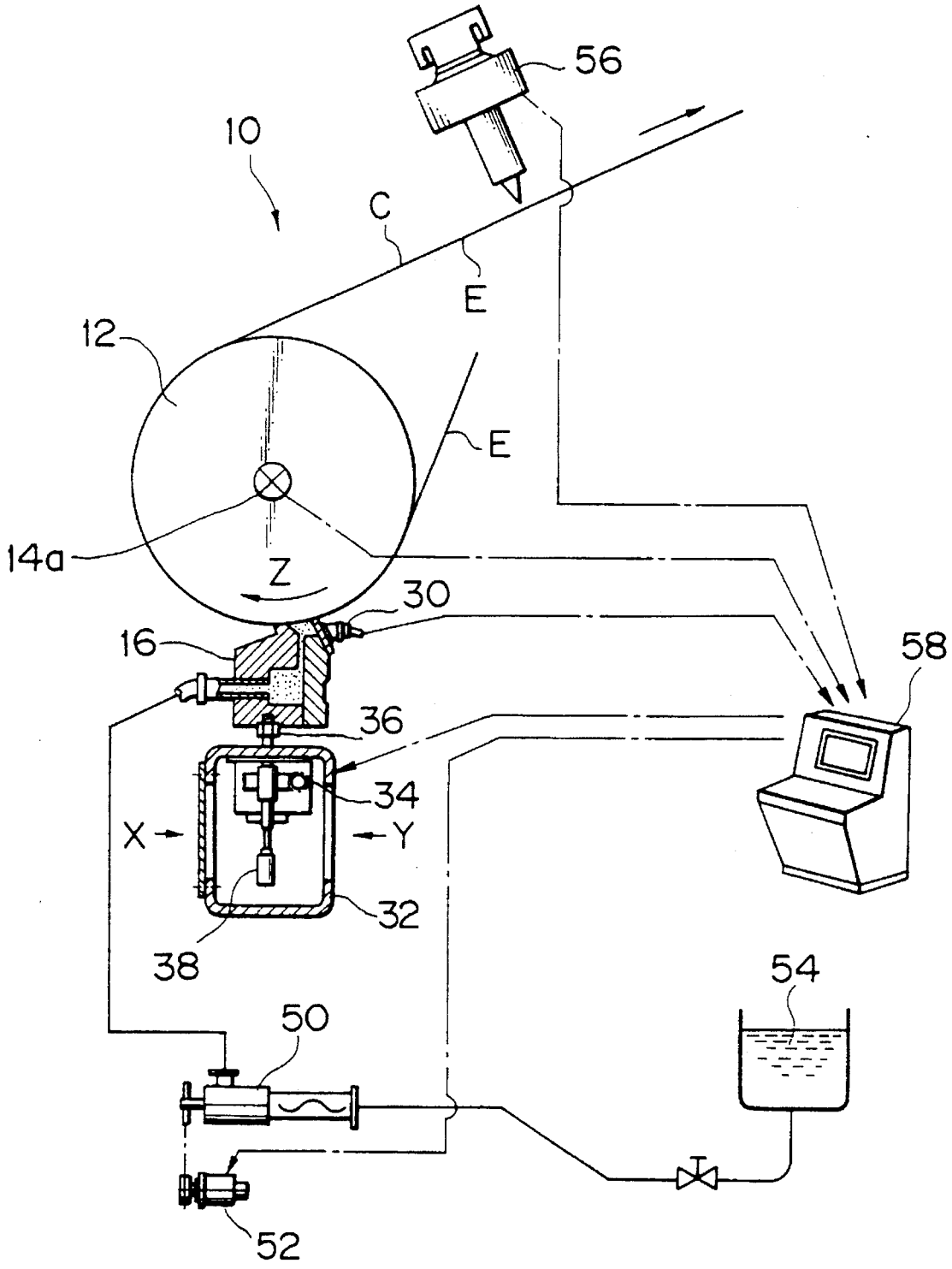
FIG. 2 is a diagrammatic side view with a partial section of the coating machine of FIG. 1.
Figure 4:
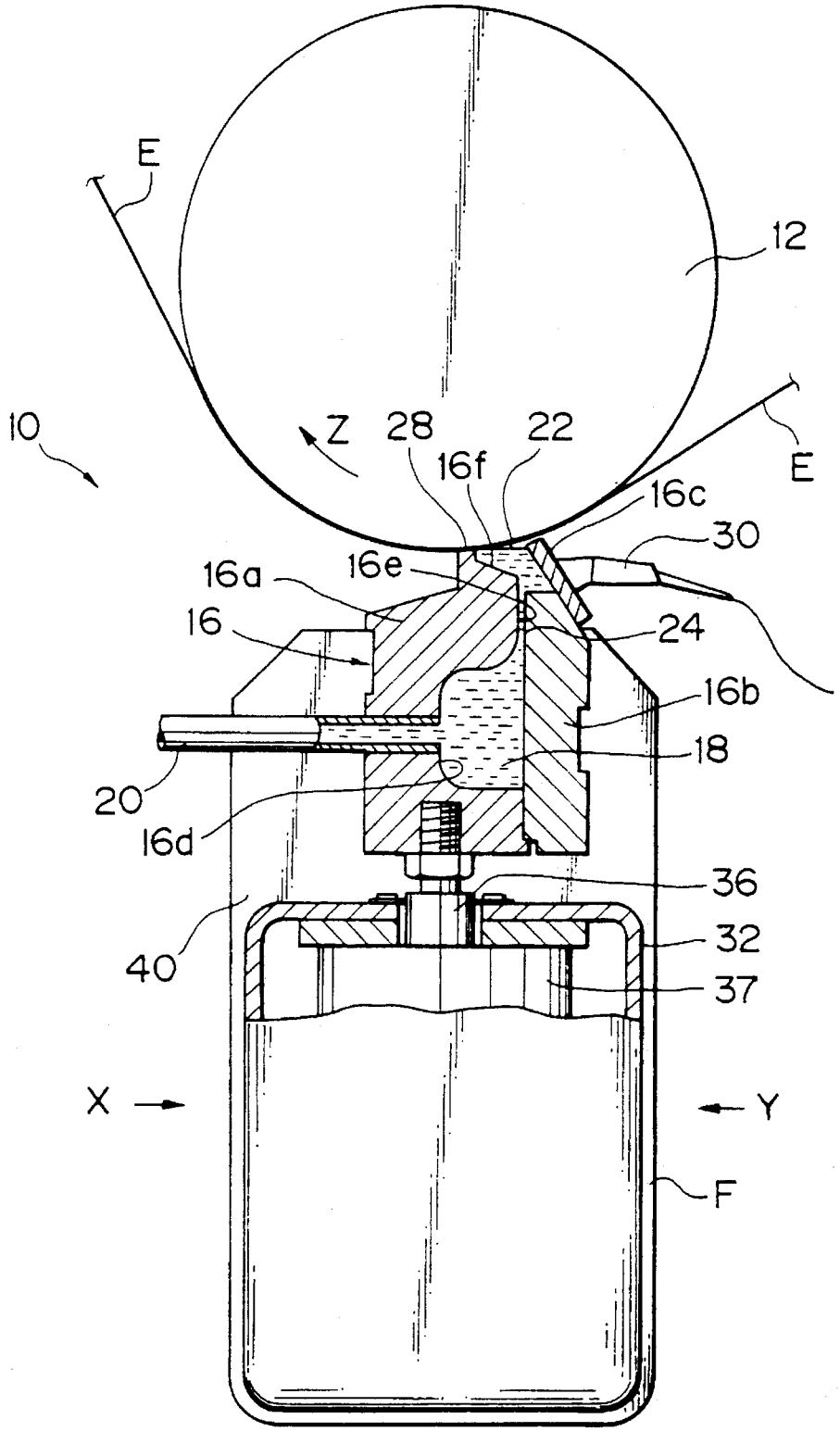
FIG. 4 is an enlarged cross-sectional view of the coating machine of FIG. 2.
Figure 5:
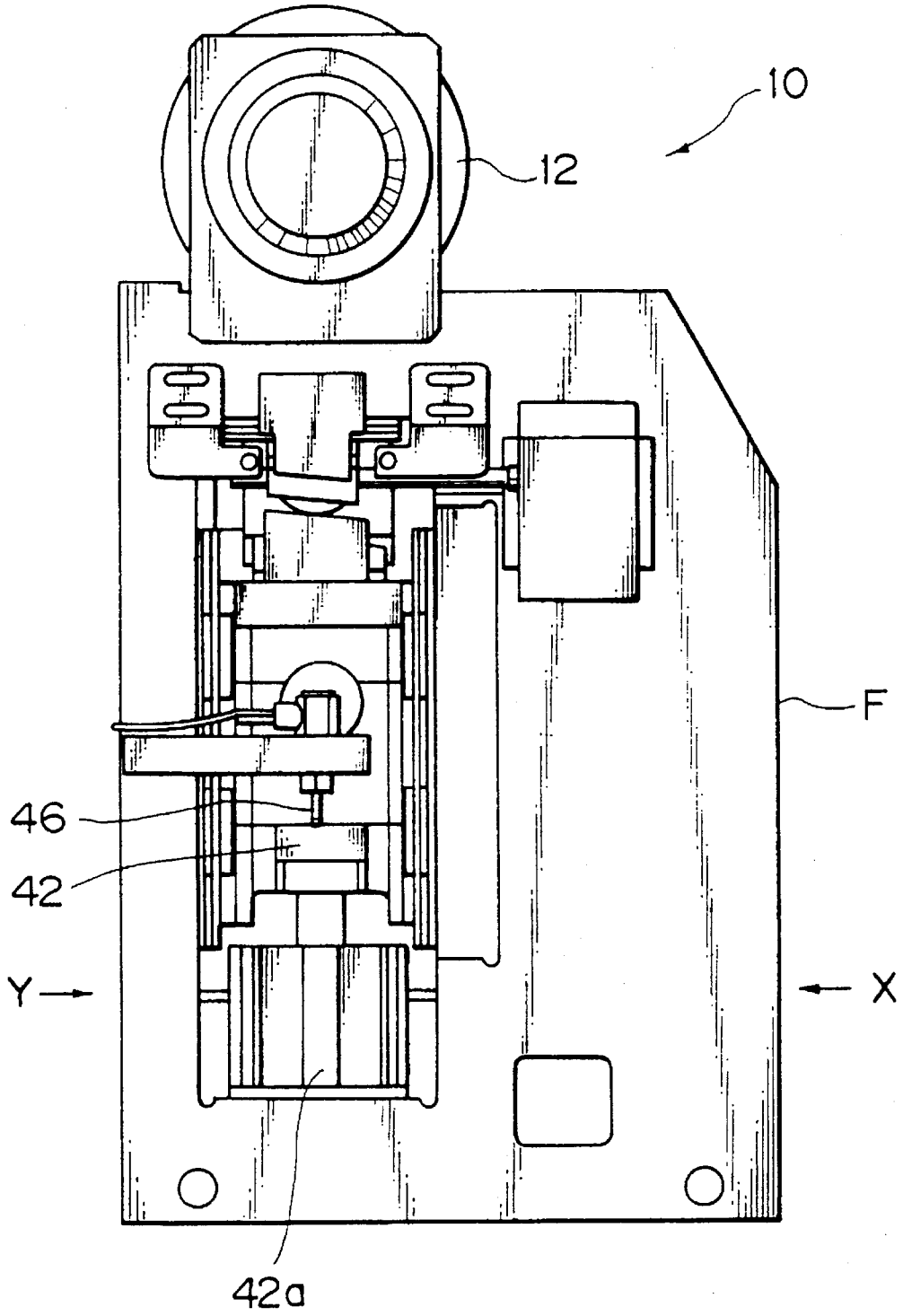
FIG. 5 is a side elevational view of the coating machine of FIG. 1.

As shown in FIGS. 2 and 4, the nozzle 16 comprises a nozzle body consisting of nozzle body halves 16*a* and 16*b* extending vertically and transversely along the frame F in an abutment relationship with each other, and a cap plate 16*c* secured to the nozzle body half 16*b*. The nozzle body half 16*a* has a cavity 16*d* to form a first chamber 18 with the flat surface of the nozzle body half 16*b*. An inlet pipe 20 is introduced into the first chamber 18; the inlet pipe 20 being connected to a pump 50 that is driven by an electric motor 54. A liquid coating material is contained in a reservoir tank 54.

The nozzle body half 16*a* also has a shallow planar cavity 16*e* to form a passage 24 between the nozzle body halves 16*a* and 16*b*, and an outlet 22 comprises a recess 16*f* on the upper wall of the nozzle body half 16*a*, which extends toward the front side X from the upper end of the passage 24 to form a second chamber 22. It will be noted that the outlet 22 or the second chamber has a size greater than a cross-sectional area of the upper end of the passage 24. A doctor edge 28 is arranged on the nozzle 16 adjacent the outlet 22 at a narrow gap between the backing roll 12 and the doctor edge 28. The first chamber 18, the passage 24 and the second chamber 22 have respective widths generally corresponding to the width of the backing roll 12. It will be noted that there are adjustable end cap plates (not shown) to close the ends of the second chamber 22 so as to determine the width of the layer C of a liquid material coated on the web E, as desired.

The second chamber 22 is substantially closed by the recess 16*e*; the upper wall of the nozzle body half 16*b* is lower than that of the nozzle body half 16*a*, the cap plate 16*c*, and the backing roll 12, except for the clearance between the backing roll 12 and the doctor edge 28 and the clearance between the backing roll 12 and the cap plate 16*c*. Accordingly, a substantial pressure can be maintained in the second chamber 22 so as to avoid air from being entrained by the liquid coating material.

A pressure sensor 30 such as a semiconductor pressure sensor is mounted to the cap plate 16*c* to detect the pressure $P_{PV}$ in the second chamber 22. Also, a revolution sensor 14*a* is mounted to the motor 14 to detect the speed of the motor 14, i.e., the conveying speed V of the web E, and a thickness sensor 56, such as a β-ray or ultraviolet thickness sensor, is arranged above the layer C coated on the web E to detect the thickness of the coated layer C. The thickness sensor 56 is arranged so as to scan the layer C and detect the thickness of the coated material C on the web E at at least three transversely selected points, seven points in the preferred embodiment. The outputs of these sensors are delivered to a control unit 58 that includes a display and a microprocessor unit with memories. The thickness data are treated in the control unit 58 so as to provide positional thicknesses $D_L$, $D_C$, and $D_R$ corresponding to the left, central and right points respectively, and the average thickness $D_P$.

Figure 3:
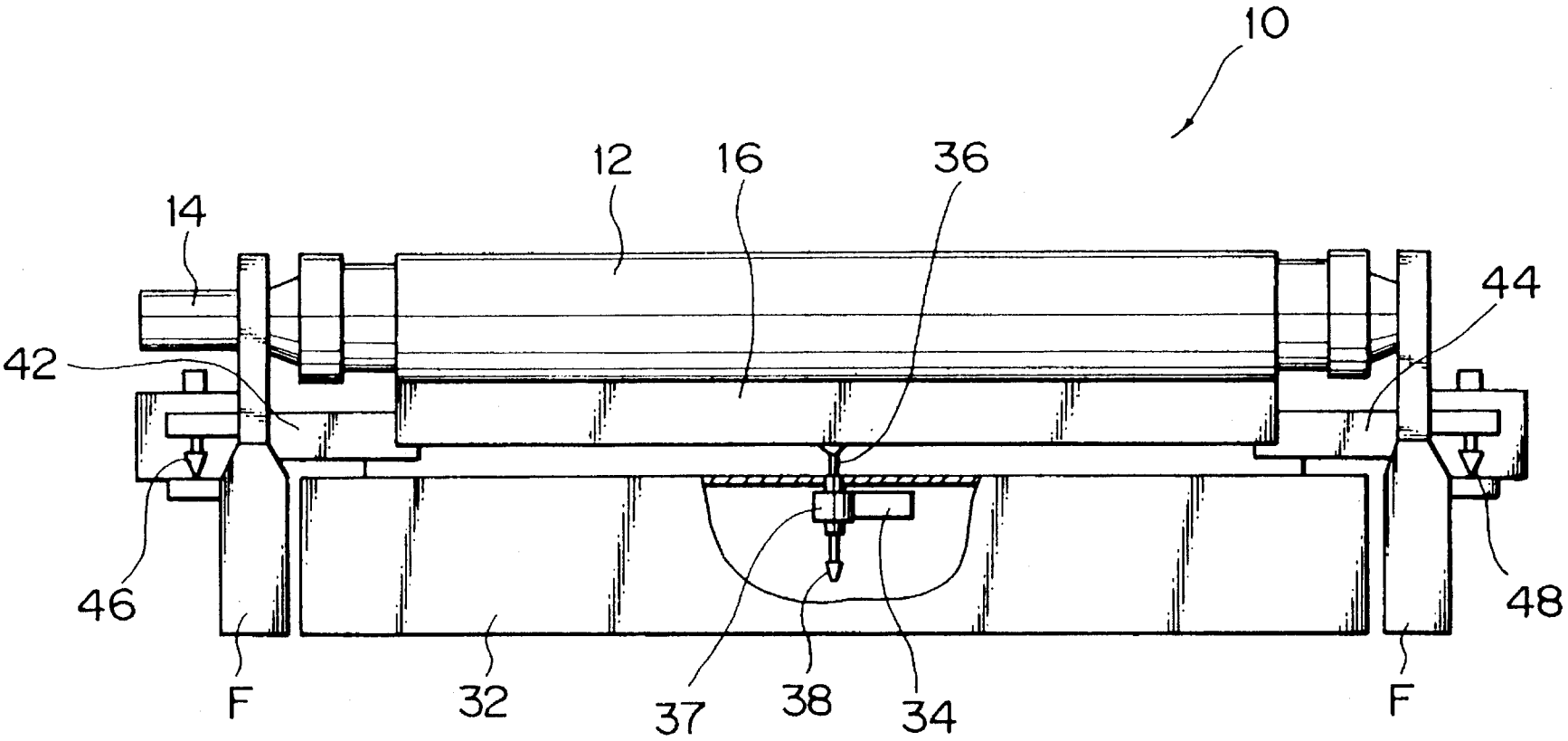
FIG. 3 is a partial front view of the coating machine of FIG. 1, showing the nozzle supporting means.

As shown in FIGS. 3 and 4, the frame F includes an inner frame member 32, and the nozzle body of the nozzle 16 is adjustably supported to the inner frame member 32 by a supporting means for adjusting the clearance between the doctor edge 28 and the backing roll 12. In the embodiment, the support means comprises a central support rod 36 located at a central region of the frame F, a left support block 42 located at a left end region of the frame F, and a right support block 44 located at a right end region of the frame F.

The central support rod 36 is fixed to the nozzle body 16 and extends into a gear box 37 that is fixedly secured to the inner frame member 32. An electric motor 34 is arranged adjacent the gear box 37 and rotatably connected to a worm wheel (not shown) in the gear box 37. The central support rod 36 includes a worm (not shown) in the gear box 37 to engage with the worm wheel of the motor 34. Accordingly, the motor 34 actuates the rod 36 to move upwardly and downwardly with the nozzle body 16 for adjusting the clearance, in microns, between the doctor edge 28 and the backing roll 12. The central support rod 36 also carries at the bottom thereof a magnetic position sensor 38 known as a magnescale (brand name) for movement with the central support rod 36 to detect the height of a central portion of the doctor edge 28 relative to the backing roll 12, i.e., the clearance between the doctor edge 28 and the backing roll 12.

The left and right support blocks 42 and 44 are secured to piston rods of actuation pneumatic cylinders 42*a* (only one shown in FIG. 1 and 5), respectively. Accordingly, the left and right support blocks 42 and 44 can also move upwardly and downwardly with the nozzle body 16 for adjusting the clearance, in microns, between the doctor edge 28 and the backing roll 12. Each of the left and right support blocks 42 and 44 has a magnetic position sensor 46 or 48 known as a magnescale (brand name) to detect the height of an end portion of the doctor edge 28 relative to the backing roll 12.

The outputs of the magnetic position sensors 38, 46 and 48 are also delivered to the microprocessor in the control unit 58 and stored in the memories. The microprocessor controls the conveying motor 14 and the pump driving motor 52 according to a predetermined program and the sensor outputs. The pump 50 outputs a predetermined quantity of liquid coating material per revolution to the nozzle 16.

Figure 6:
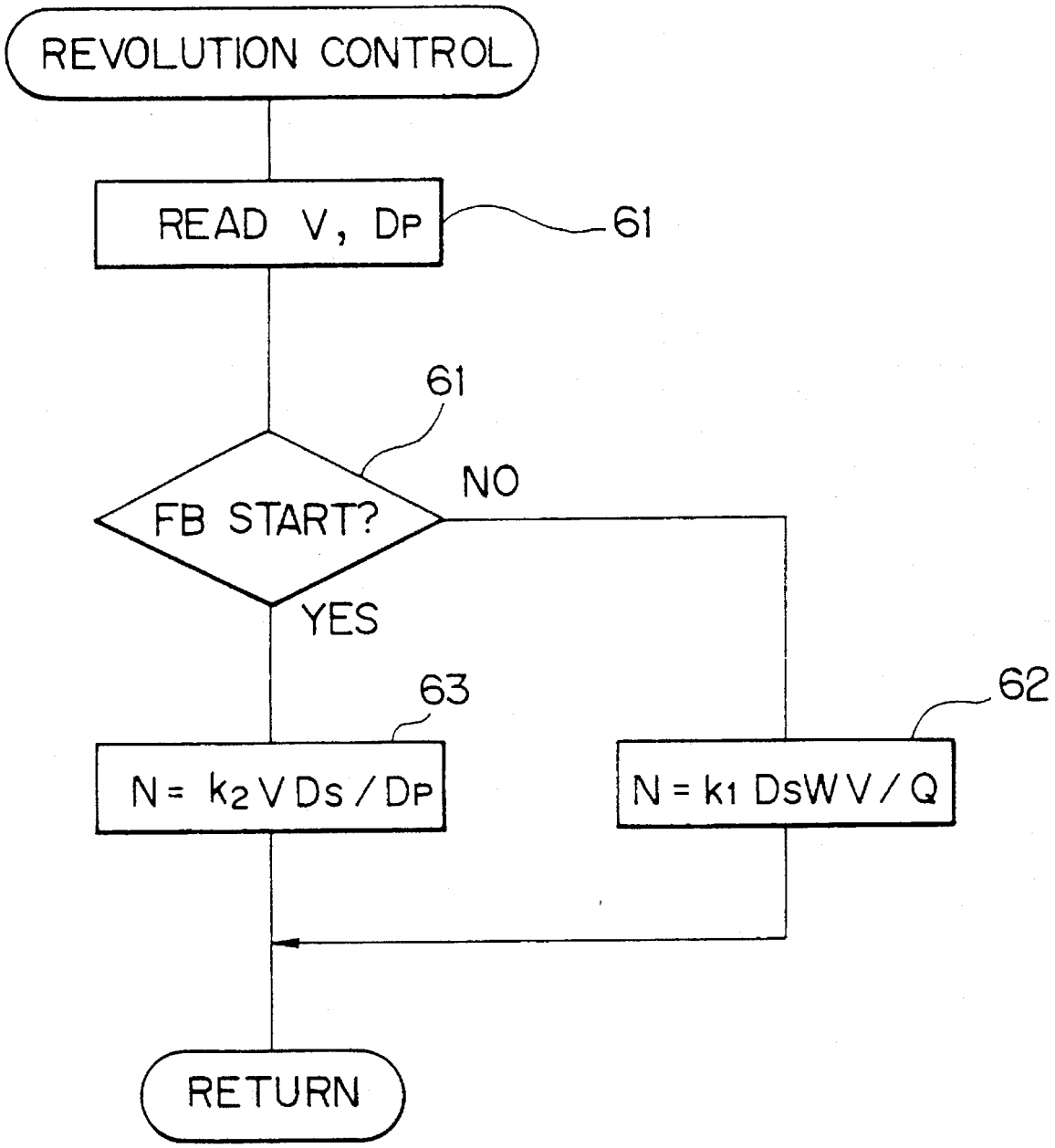
FIG. 6 is a flow chart for controlling the motor of the pump.
Figure 7:
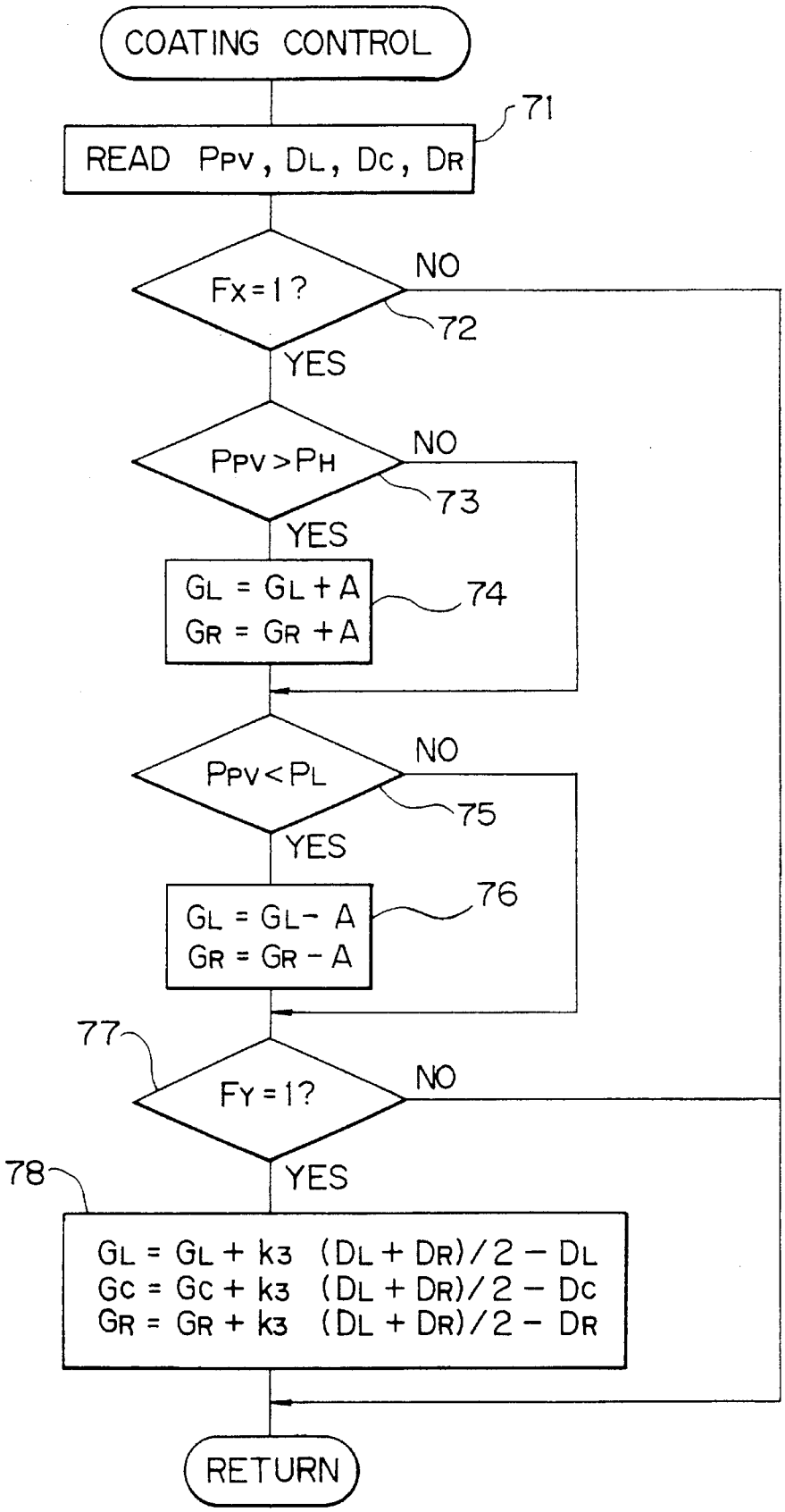
FIG. 7 is a flow chart for controlling the adjustable support means.

FIG. 6 is a flow chart for controlling the motor 52 of the pump 50, and FIG. 7 is a flow chart for controlling the adjustable support means 36, 42, 44. The program is repeated at one minute intervals.

In FIG. 6, at the step 61, the detected speed V and the detected average thickness $D_P$ are read from the memory. At the step 62, it is determined whether a feed back is to be started or not. If the result of the step 61 is NO, i.e., the machine does not reach a predetermined speed after starting the machine, or a coating operation is not yet stable, the program proceeds to the step 62 to control the speed of the pump 50 according to the following relationship:

$$N=k_1D_SWV/Q \quad (1)$$

where N is the rotational speed of the pump, $k_1$ is a constant, $D_s$ is a selected thickness (mm) of the coated liquid material on the web, W is a width (mm) to be coated, V is the detected conveying speed (m/minute), and Q is the output of the pump per revolution (cc/rev.). This relationship can be directly understood, and it is possible for the pump 50 to follow changes in the detected speed V of the web E.

If the result of the step 61 is YES, the program proceeds to the step 63 so as to control the speed of the pump 50 according to the following relationship:

$$N=k_2VD_S/D_P \quad (2)$$

where N is the rotational speed of the pump, $k_2$ is a constant, $D_S$ is a selected thickness of the coated liquid material on the web, and $D_P$ is the detected thickness of the coated liquid material on the web.

Since the constant $k_1$, the thickness $D_S$, and the width W are preselected constants and are stored in the memories and the pump output Q is constant for the pump 50 used, the relationship (1) results in the following:

$$N=k_3VD_S \quad (3)$$

In the actual coating operation, there is a variation in the coated thickness and it is preferable to carry out a feed back control by using the detected thickness $D_P$ of the coated layer C on the web E. If the detected thickness $Di_P$ of the coated layer C is greater than the preselected thickness $D_S$it is necessary to reduce the speed N of the pump 50. Accordingly, the relationship (2) is obtained. By this control method, it is possible for the pump 50 to follow any variation in the detected thickness $D_P$ and provide a uniform thickness.

In FIG. 7, at the step 71, the detected pressure $P_{pv}$, and the positional thickness $D_L$, $D_C$ and $D_R$ are read from the memory. At the step 22, it is determined whether a flag $F_X$ is set or not, wherein the flag $F_X$ is set when the machine is in a condition to allow the feed back control of the adjustable support means 36, 42, 4. If the result of the step 72 is NO, the cycle ends. If the result of the step 72 is YES, the program proceeds to the step 73 where it is determined whether the detected pressure $P_{pv}$ is greater than the predetermined maximum $P_H$.

Figure 8:
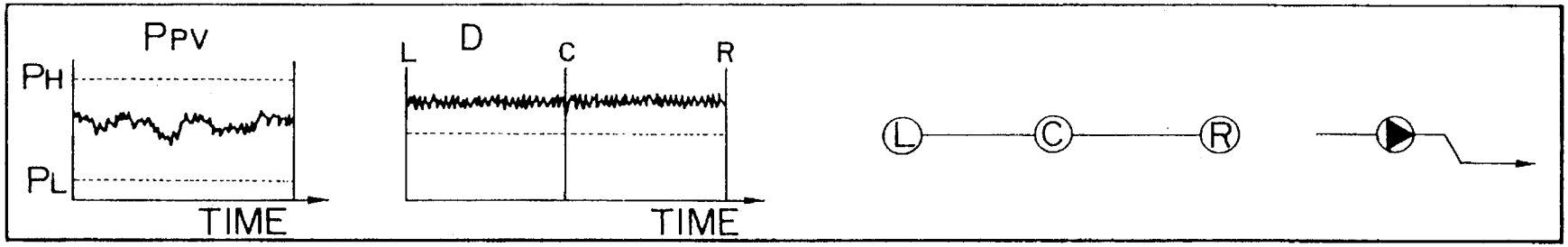
FIGS. 8 to 12 are views illustrating the control manner of the pump and the adjustable support means.

FIGS. 8 to 12 show several examples of the detected data and the manner of controlling the adjustable support means 36, 42, 44 and the pump 50. In each of these Figures, the left-hand Figure shows the detected pressure $P_{pv}$, a predetermined maximum $P_H$ and a predetermined minimum $P_L$. The intermediate left-hand Figure shows the detected width D during one scan of the thickness sensor 56 from which the detected average thickness $D_P$, and the positional thickness $D_L$, $D_C$ and $D_R$ are obtained. The right-hand Figure shows the manner of controlling the pump 50. The intermediate right-hand Figure shows the manner of controlling the adjustable support means 36, 42, 44, wherein the characters L, C and R in the respective circles represent the left support block 42, central support rod 36, and the right support block 42, and the arrows show movements of these support elements. In FIG. 8, for example, the detected average thickness $D_P$ is relatively high, and the rotational speed of the pump 50 is reduced in accordance with the step 63 of FIG. 6.

In FIG. 7, as described above, it is determined whether the detected pressure $P_{pv}$ is greater than the predetermined maximum $P_H$ at the step 73. If the result is YES, the microprocessor in the control unit 58 controls the pneumatic cylinders 42*a* and 44*a* of the support blocks 42 and 44 so that the clearance between the doctor edge 28 and the backing roll 12 is widened, respectively.

Figure 9:
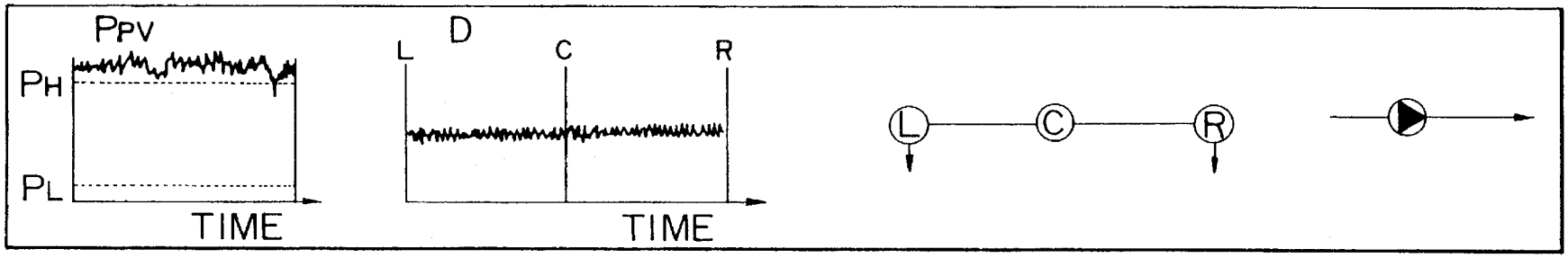

In the embodiment, $G_L$, $G_C$ and $G_R$ are used to represent clearances between the doctor edge 28 and the backing roll 12 at the left end, the central point, and the right end, respectively. At the step 74 in FIG. 7, the control is carried out so that the clearances $G_L$ and $G_R$ are increased by a small constant A, respectively. This is illustrated in FIG. 9.

Also, at the step 75, it is determined whether the detected pressure $P_{pv}$ is smaller than the predetermined minimum $P_L$, and if the result is YES, the program proceeds to the step 76 and the microprocessor in the control unit 58 controls the pneumatic cylinders 42*a* and 44*a* of the support blocks 42 and 44 so that the clearance between the doctor edge 28 is narrowed by reducing the clearances $G_L$ and $G_R$ a small constant B. In this way, a constant pressure in the second chamber 22 of the nozzle 16 is maintained, and it is possible to obtain a uniform layer of the coating C on the web E.

10 If the results of the steps 73 and 75 are NO, the program proceeds to the step 77 and it is determined whether a flag $F_Y$ is set or not. In this case, the flag $F_Y$ is set when the machine is in a condition to allow a further feed back control of the adjustable support means 36, 42, 44. If the result of the step 77 is YES, the microprocessor in the control unit 58 controls the pneumatic cylinders 42*a* and 44*a* of the support blocks 42 and 44 and the motor 34 of the support rod 36 in accordance with the respective positional thickness $D_L$, $D_C$ and $D_R$ depending on the following relationships:

$$G_L=G_L+k_4\{(D_L+D_R)/2-D_L\} \quad (4)$$

$$G_C=G_C+k_4\{(D_L+D_R)/2-D_C\} \quad (5)$$

$$G_R=G_R+k_4\{(D_L+D_R)/2-D_R\} \quad (6)$$

where $k_4$ is a constant.

Figure 10:
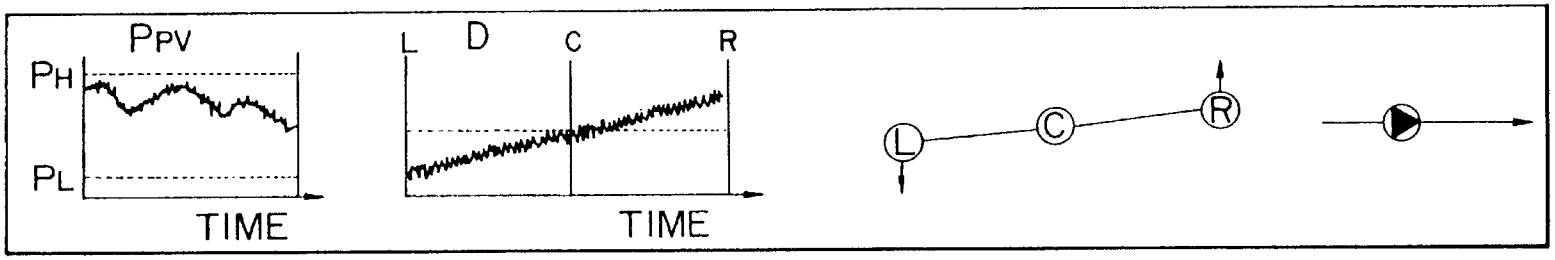
Figure 11:
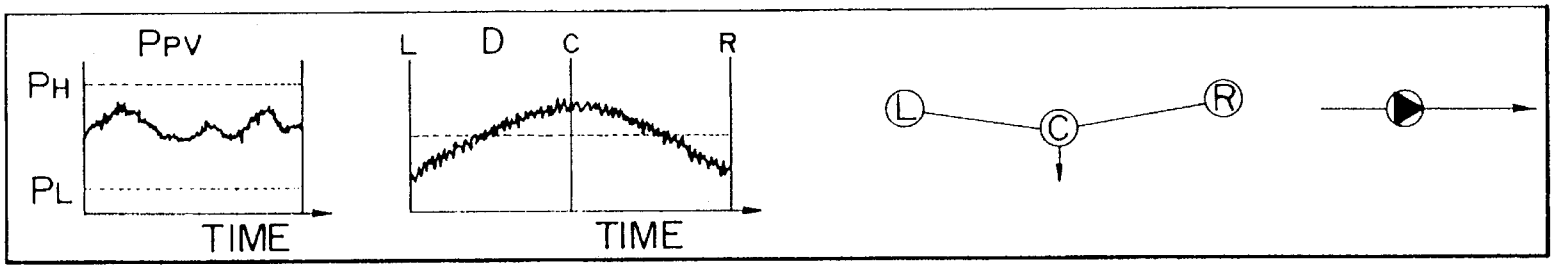
Figure 12:
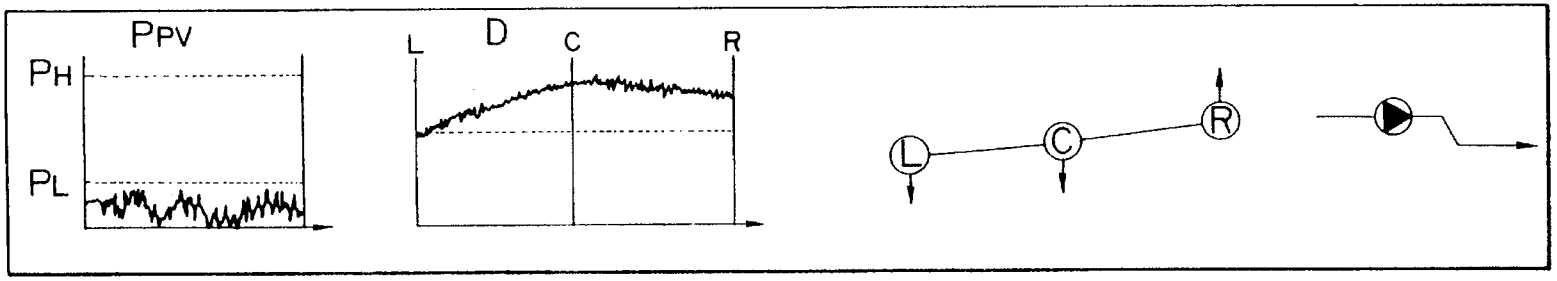

The manner of operation depending on this control is exemplified in FIGS. 10 and 11, respectively. Further, it will be understood that the adjustable support means 36, 42, 44 and the pump 50 can be simultaneously controlled, as shown in FIG. 12.

Figure 13:
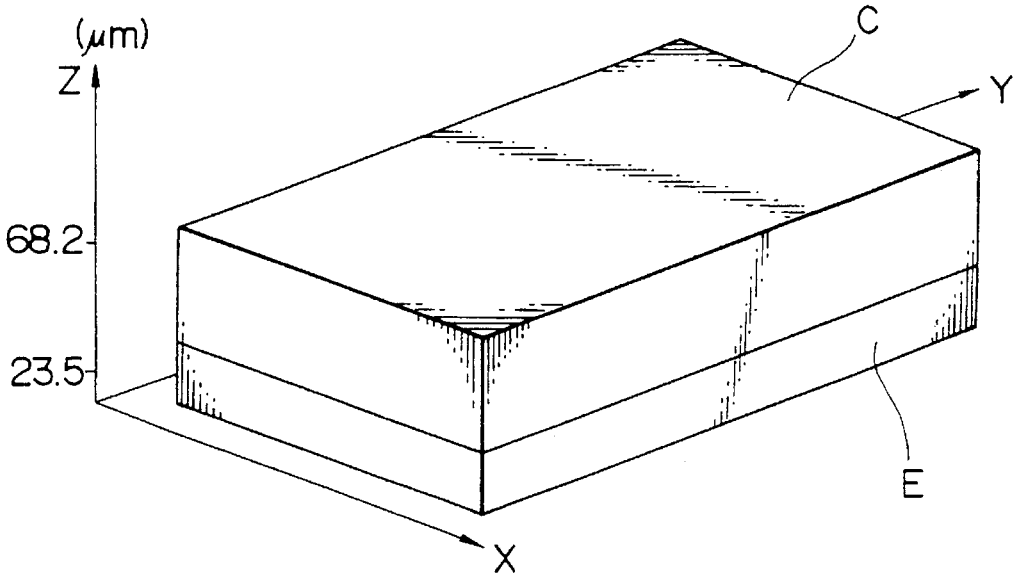
FIG. 13 is a diagrammatic view of the coated layer on the web according to the present invention.
Figure 14:
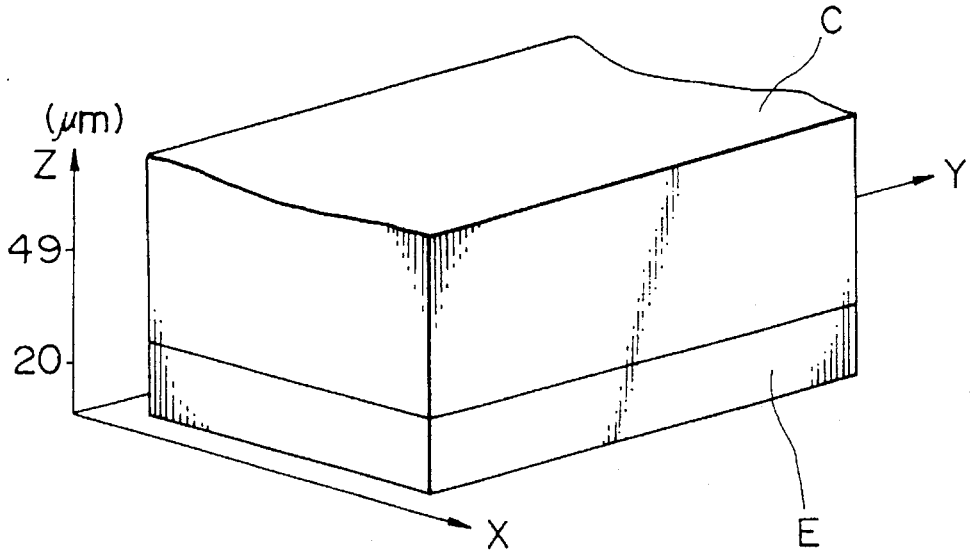
FIG. 14 is a diagrammatic view of the defectively coated layer on the web.
Figure 15:
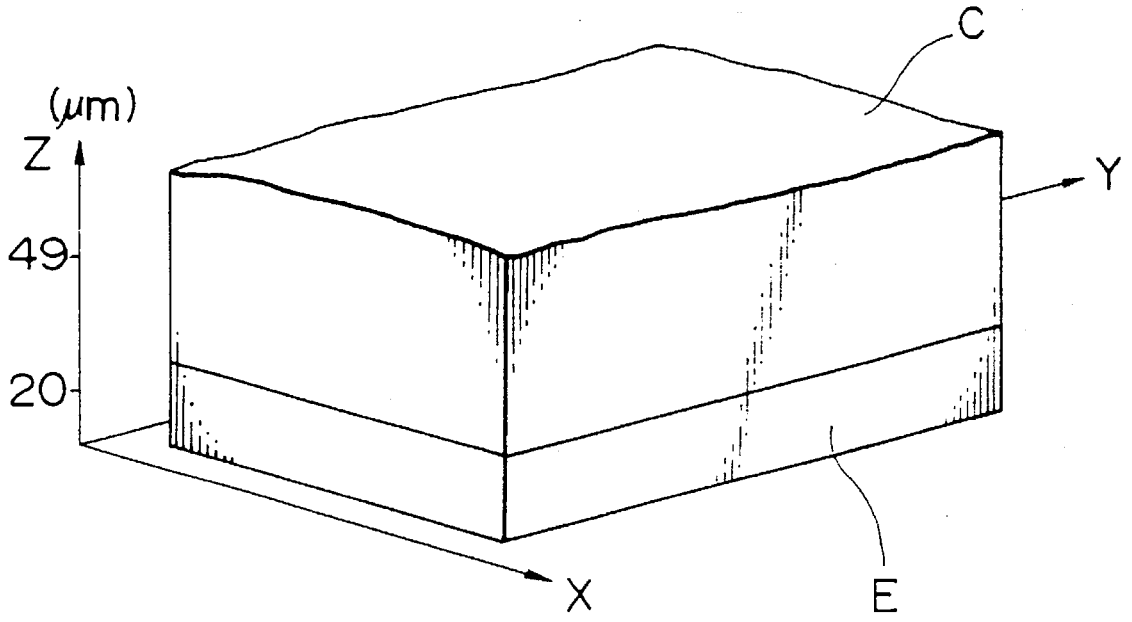
FIG. 15 is a diagrammatic view of the another example of the defectively coated layer on the web.

FIG. 13 is a diagrammatic view of the coated layer C on the web E according to the present invention, in which the coated layer C is uniform in all directions. FIGS. 14 and 15 are examples of the defectively coated layer C on the web E, obtained by a coating machine not using the above described features. In FIGS. 14 and 15, the coated layer C is not uniform.

We claim:

1. A coating machine comprising a frame;

a backing roll rotatably mounted to the frame for conveying a web to be coated at a conveying speed;

a nozzle mounted to the frame below the backing roll and extending parallel to the backing roll, the nozzle comprising a nozzle body having an upper wall, an inlet for receiving a liquid coating material, a first chamber connected to the inlet, a passage with a width generally corresponding to a width of the backing roll, said passage having a first end connected to said first chamber and a second end connected to an outlet for discharging the liquid coating material under pressure toward a web on the backing roll, the frame having a front side and the web to be coated travels from the front side of the frame past the nozzle;

the outlet comprising a recess in the upper wall having a size greater than a cross-sectional area of the second end of the passage and extending at least toward the front side to form a second chamber between the upper wall of the nozzle body and the backing roll;

a doctor edge arranged on the nozzle adjacent the outlet at a clearance between the backing roll and the doctor edge;

a support means including at least one actuator for adjustably supporting the nozzle body to the frame and for adjusting said clearance between the doctor edge and the backing roll;

a pump outputting a predetermined quantity of liquid coating material per revolution for supplying a liquid coating material to the inlet of the nozzle;

a first detecting means for detecting the conveying speed of the web;

a second detecting means for detecting a thickness of a layer of the coated material on the web;

a third detecting means for detecting a pressure in the second chamber of the nozzle;

a first control means for controlling a speed of the pump in response to output signals of the first and second detecting means;

a second control means for controlling the actuator of the support means in response to an output signal of the third detecting means as well as the output signal of said second detecting means.

2. A coating machine according to claim 1, wherein the support means comprises a central support element including an actuator located at a central region of the frame, a left support element including an actuator located at a left end region of the frame, and a right support element including an actuator located at a right end region of the frame for adjustably supporting the nozzle body to the frame for adjusting said clearance between the doctor edge and the backing roll, respectively.

3. A coating machine according to claims 2, wherein the second detecting means detects a thickness of the coated material on the web at at least three transversely selected points across the width of said web.

4. A coating machine according to claim 3, wherein the second control means controls the left and right support means so that said clearance between the doctor edge and the backing roll is widened when the detected pressure is higher than a predetermined maximum and the clearance is narrowed when the detected pressure is lower than a predetermined minimum.

5. A coating machine according to claim 4, wherein the second control means controls each of the actuators of the left, central and right support means in response to the detected pressure at the correspondingly located point, said actuators of said left, central and right support means being located respectively at said three transversely selected points.

6. A coating machine according to claim 5, wherein the second control means controls each of the actuators of the left central and right support means depending on the following relationships:

$$G_L=G_L+k_4\{(D_L+D_R)/2-D_L\} \quad (4)$$

$$G_C=G_C+k_4\{(D_L+D_R)/2-D_C\} \quad (5)$$

$$G_R=G_R+k_4\{(D_L+D_R)/2-D_R\} \quad (6)$$

where $G_L$, $G_C$ and $G_R$ are clearances between the doctor edge and the backing roll at a point of one of the left, central and right support means, $D_L$, $D_C$ and $D_R$, and are the detected pressures at said three transversely selected points, and $k_4$ is a constant.

* * * * *